US005702289A

United States Patent [19]

Champaigne

[11] Patent Number: 5,702,289

[45] Date of Patent: Dec. 30, 1997

[54] ANTI-GRAVITY BLAST CLEANING

[75] Inventor: Jack M. Champaigne, South Bend, Ind.

[73] Assignee: Electronics, Incorporated, Mishawaka, Ind.

[21] Appl. No.: 623,609

[22] Filed: Mar. 28, 1996

Related U.S. Application Data

[63] Continuation-in-part of Ser. No. 309,932, Sep. 20, 1994, abandoned.

[51] Int. Cl.[6] ..... B24B 1/00

[52] U.S. Cl. ..... 451/38; 451/90; 451/95; 451/96; 451/99; 451/102; 72/53

[58] Field of Search ..... 451/38, 36, 39, 451/60, 91, 95, 99; 29/90.3; 134/7; 72/53

[56] References Cited

U.S. PATENT DOCUMENTS

| | | | |
|---|---|---|---|
| 4,561,220 | 12/1985 | Carpenter et al. | 451/91 |
| 5,212,976 | 5/1993 | Company | 29/90.7 |
| 5,271,255 | 12/1993 | Thompson et al. | 451/38 |
| 5,364,474 | 11/1994 | Williford | 134/7 |
| 5,417,608 | 5/1995 | Elliott | 451/39 |
| 5,526,664 | 6/1996 | Vetter | 72/53 |

FOREIGN PATENT DOCUMENTS

| | | | |
|---|---|---|---|
| 0007245 | 2/1987 | Japan | 72/53 |

*Primary Examiner*—James G. Smith
*Assistant Examiner*—George Nguyen
*Attorney, Agent, or Firm*—Baker & Daniels

[57] ABSTRACT

A shot peening method and apparatus enables low intensity peening at a velocity which is equal to or less than the minimum velocity required to assure conveyance of the media through the transport hose in pneumatic systems or the minimum velocity necessary to project a coherent shot stream in the case of wheel systems.

13 Claims, 6 Drawing Sheets

ANTI-GRAVITY BLAST CLEANING

This application is a Continuation-in-part of U.S. Pat. No. 08/309,932 filed Sep. 20, 1994, and now abandoned.

BACKGROUND OF THE INVENTION

The present invention relates generally to blast cleaning apparatus and, more particularly, to a blast cleaning apparatus capable of providing a variety of selected cleaning intensities to a workpiece.

Blast cleaning is a broad classification of cleaning in which a cleaning media is propelled against a target surface to achieve a cleaning effect. Sandblasting or grit blasting is a type of blast cleaning in which steel, grit, sand, or another abrasive material is blown against an object to produce a roughened surface or to remove dirt, rust, and scale.

Shot peening is another type of blast cleaning. Peening is a well known process for shaping and/or finishing the surface of a workpiece such as a metal sheet or plate. Conventional shot peening devices include a mechanical or pneumatic means to propel the metal shot. More recently, peening devices have been developed that rely solely on gravitational acceleration of the shot to provide the desired impact force of the shot against the workpiece.

Shot peening intensity is determined by several factors, namely shot size, shot hardness, and shot velocity. The shot size is chosen by the desired surface finish required and minimum fillet that must be peened. The shot hardness is chosen to be compatible with the hardness of the peened material. The remaining variable, velocity, is the factor most often used to achieve the desired peening intensity. A low intensity peening treatment is desirable, and a smooth finish is essential. Generally, a small shot size is used for low intensity peening and a large shot is used for smooth surface finish.

Conventional peening practice utilizes either a wheel type peening machine or an air type peening machine. The shot velocity in wheel type peening machines is determined by the rotational speed of the peening wheel. The shot velocity in air type peening machines is determined primarily by the air pressure used to propel the shot. Other factors, such as nozzle size and hose size are also important, but they are of secondary interest since they are treated as relatively constant.

Conventional peening practice utilizing either wheel type or air type peering technology has severe limitations in providing a desired surface finish. Since only one size shot can be used, there must be a compromise between the desired low intensity or smooth surface. Both systems suffer from their inability to convey the shot from the hopper to the projecting device, e.g., wheel or nozzle, at a velocity high enough to ensure conveyance to the target path, but at a velocity low enough to restrict the impact at the target to a desirably low intensity. Peening devices which use a shot size that is too small will result in a rough surface finish that creates small metal folds as potential stress risers. The use of a larger shot size in conventional peening machines is not practical because the larger shot produces too high of an intensity. When the velocity of the shot in the air peening machines is reduced to achieve low intensity peening, the shot cannot stay in conveyance in the blast hose. The use of large size shot in wheel type peening machines is not practical because the minimum operating speed of the throwing wheel imparts too high of a shot velocity.

Shot peening has been used in the manufacture of high speed aircraft to impart stress corrosion resistance, enhance fatigue properties and correct configurations or contours. However, the design of aircraft jet engines of increasingly high performance has created a need for new methods of imparting residual compressive stresses to the fan blade airfoil. In U.S. Pat. No. 3,705,511 there is disclosed a gravity-assisted shot peening process that allows the use of a larger size shot at a low velocity. However, this type of machine is only suitable for the large mostly flat type of peening targets, and not intricate shapes like fan blades.

As discussed above, in a pneumatic conveyance system, a certain minimum velocity of the shot particles must be maintained in order to maintain conveyance of the particles in the air stream. As also discussed above, in wheel type systems, a certain minimum velocity of the shot particles is required as they come off of the wheel in order to maintain a coherent shot stream. In the air type system, the problems of achieving low intensity peening are compounded because conventional peening technology requires the use of a nozzle. Accordingly, in prior art systems it was not possible to peen at a shot velocity lower than the minimum shot velocity required to maintain conveyance in pneumatic conveyance systems or to maintain a coherent shot stream in wheel systems. In conventional pneumatic systems, because a nozzle is used, the minimum velocity is greater than the velocity necessary to maintain conveyance, since the nozzle inherently accelerates the velocity of the shot particles.

SUMMARY OF THE INVENTION

According to the present convention, peening may be effected at velocities equal to or less than the conveyance velocity required to maintain conveyance of particles in a pneumatic type system, or equal to or less than the minimum velocity required to maintain a coherent shot stream in wheel type systems. In pneumatic systems, peening can be effected at the conveyance velocity simply by omitting the nozzle on the end of the transport hose. In both pneumatic and wheel systems, velocities equal to or less then the minimum velocity are achieved by propelling the media upwardly against the force of gravity towards a target. This creates a cleaning "fountain," which enables the user to conveniently vary the intensity of the cleaning operation. The velocity of the propelled media can thus be varied from a desired maximum near the outlet of the cleaning apparatus to a minimum of zero, which occurs at the apex of the cleaning fountain. By maintaining a constant media flow rate and expulsion pressure, the cleaning intensity can be determined solely as a function of the distance that the target is spaced from the outlet nozzle of the cleaning apparatus.

The apparatus according to the present invention comprises either a wheel type peening machine or an air type peening or blast cleaning machine. The outlet of the peening device is pointed upwardly, and shot or sand is forced upwardly to a fountain height determined by the exit velocity from the machine. At the apex of the fountain, the shot has lost all of its kinetic energy and reverses direction due to the force of gravity. By moving the target workpiece between the apex of the shot fountain and the outlet of the peening or blasting machine, the velocity of the shot or sand impacting the target material can be varied from a maximum at the outlet to essentially zero velocity at the apex. Accordingly, a very precise intensity control can be achieved.

By utilizing this method of peering in air peening machines, the air pressure can be adjusted to achieve the desired shot velocity in the blast hose for proper conveyance to assure a smooth immediate delivery. The wheel speed can be adjusted to an appropriate amount in wheel type peening machines. In either case, the range of intensity is greater than that available by the gravity-assisted method. Visual observation of the fountain height is all that is needed to calibrate the shot velocity and intensity.

DESCRIPTION OF THE PREFERRED EMBODIMENTS

Figure 1:
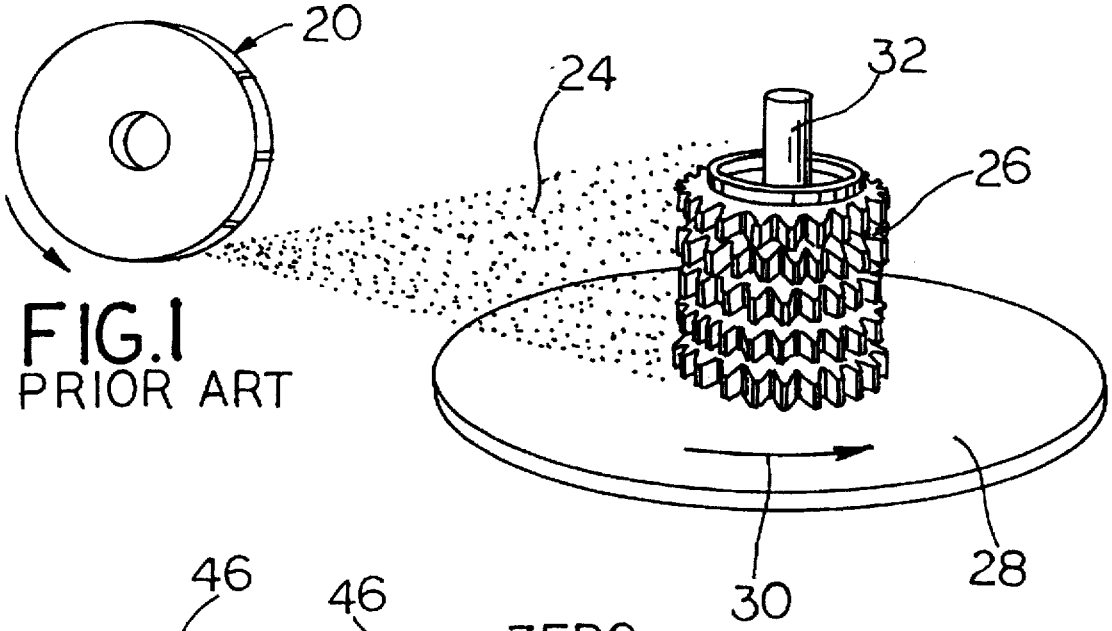
FIG.1 PRIOR ART
FIG. 1 is a perspective view of a conventional shot peening apparatus, particularly showing the air peening nozzle aimed horizontal to the workpiece.

Referring to FIG. 1, there is shown a prior art shot peening apparatus to the wheel type. Wheel 20 propels a stream of shot 24 toward a rotating target 26, which in this instance is a stack of automotive transmission gears. The gears are supported on a turntable 28 that is rotating in the direction of arrow 30. The target 26 is fixed in place on turntable 28 by an upstanding rod 32.

Figure 2:
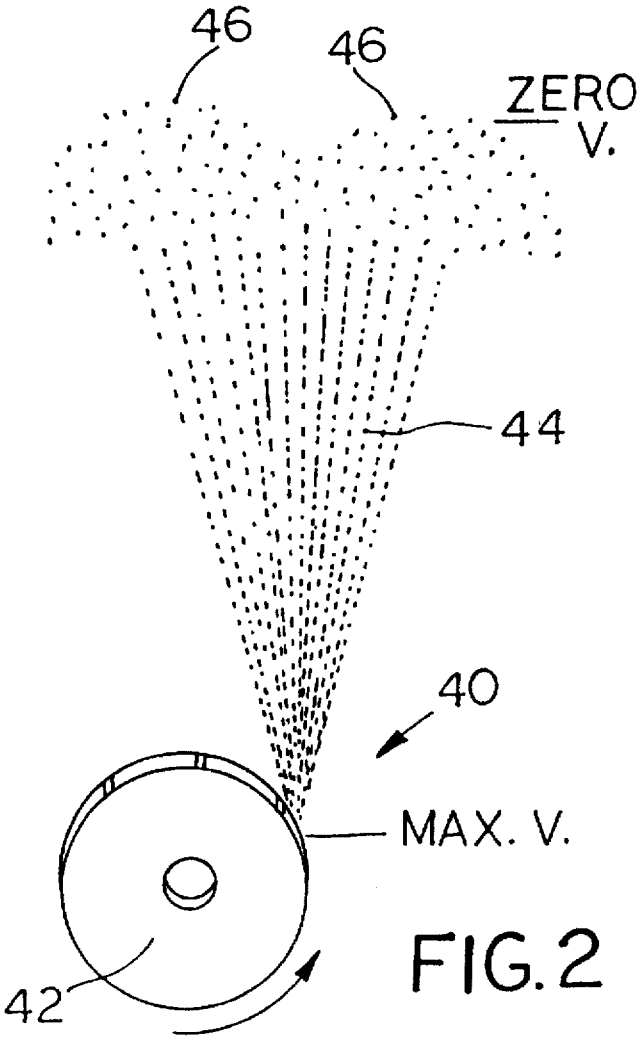
FIG. 2 is a perspective view of a peening apparatus in accordance with one embodiment of the present invention, particularly showing the shot stream direction being directed upwardly.
Figure 3:
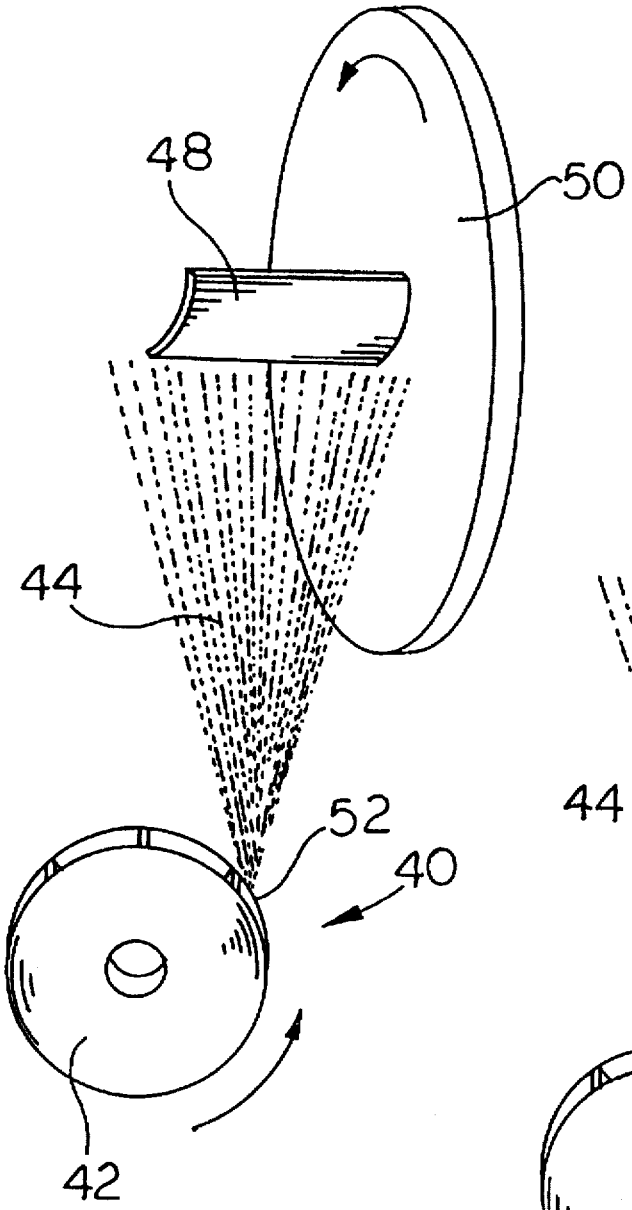
FIG. 3 is a perspective view of the shot peening apparatus of FIG. 2, wherein the target is positioned for relatively low velocity peening.
Figure 4:
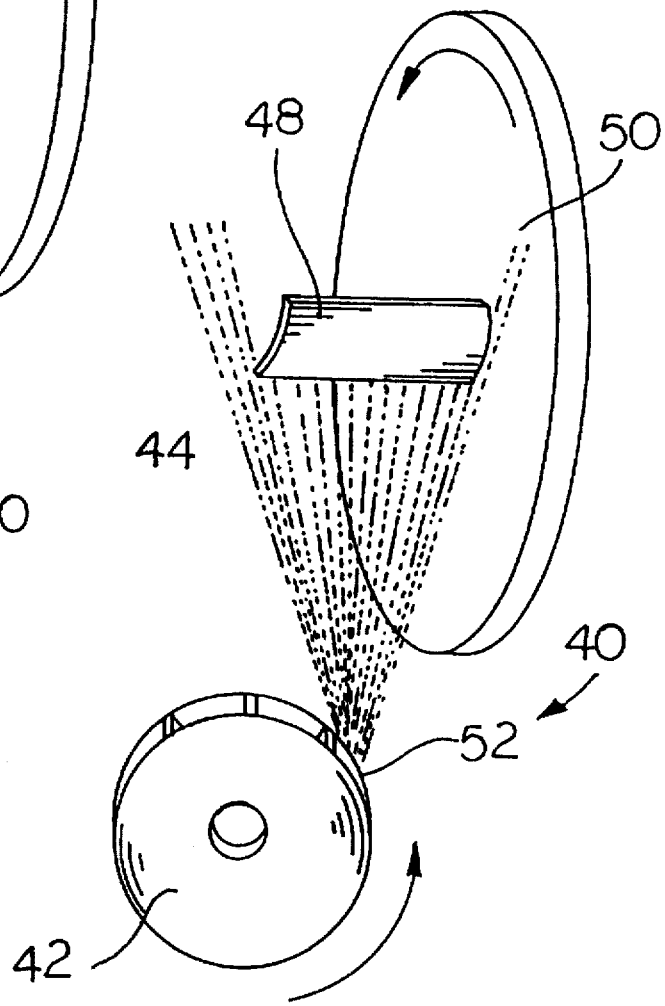
FIG. 4 is a perspective view of the shot peening apparatus of FIGS. 1 and 2, wherein the target is positioned for relatively higher velocity peening.

In accordance with an embodiment of the present invention, FIGS. 2–4 illustrate a wheel type shot peening apparatus 40 having a wheel 42 that is oriented to direct the shot stream 44 upwardly against the force of gravity. This results in a "fountain-shaped" spray with the shot at the apex 46 of the fountain having a velocity of zero. Thus, the velocity of individual shot decreases as the shot reaches its apex. As shown in FIG. 3, a target is placed near the apex of the fountain, resulting in a delicate and gentle peening action. The peening is gentle because the velocity of the shots near the apex of the fountain is near zero. In FIG. 4, the target is shown nearer to the outlet of the peening apparatus. Thus, the target is peened at a higher velocity than in the arrangement shown in FIG. 3.

In the apparatus illustrated in FIG. 1 representing the prior art, a certain minimum velocity of the shot stream 24 is necessary to propel the shots toward the target 26 and to prevent the shot from dropping out of the shot stream. Accordingly, the intensity of the peening, which is a function of the velocity of the shot as well as its mass, can only be regulated to a certain minimum velocity. Oftentimes, a lower intensity of peening is desirable in which the velocity of the shot particles must be below that necessary to maintain the particles in the shot stream. However, referring to FIG. 2, the shot stream 44 is propelled upwardly against the force of gravity. The height of the apex 46 can be regulated by regulating the velocity of the shot just as it comes off the wheel 42, which is a function of the rotational speed of the wheel 42. Referring to FIG. 3, a workpiece 48, which is illustrated in this case to be turbine blade to be used in a jet aircraft engine, is mounted on a turntable 50. As illustrated in FIG. 3, the workpiece 48 is positioned just inside of the apex 46 and then rotated to assure proper peening of all surfaces of the target workpiece 48. Since the velocity of the particles at the apex 46 is essentially zero (as the shot falls back toward the wheel 42), by placing the workpiece 48 just below the apex 46 assures that the shot impacting the workpiece 48 will be traveling at a minimum velocity. Accordingly, the desirable low intensity peening is achieved. The velocity of the shot particles just below the apex 46 is much less than the minimum velocity at which the shot stream 24 can be maintained in prior art peening methods and still form a coherent shot stream necessary to peen the target material 26. Referring to FIG. 4, if a higher intensity peening is desired, the workpiece 48 and turntable 50 may be lowered to a lower level within the fountain of shot particles 44. Since the workpiece 48 is now further from the apex 46 and close to the maximum velocity of shot at the periphery 52 of the wheel 42, the velocity of the shot, and hence intensity of the peening, will be greater than that illustrated in FIG. 3. Alternatively, the height of the fountain shot may be raised or lowered to change the velocity of the shot impacting the workpiece 48 by increasing and decreasing the rotational speed of the wheel 42.

Figure 5:
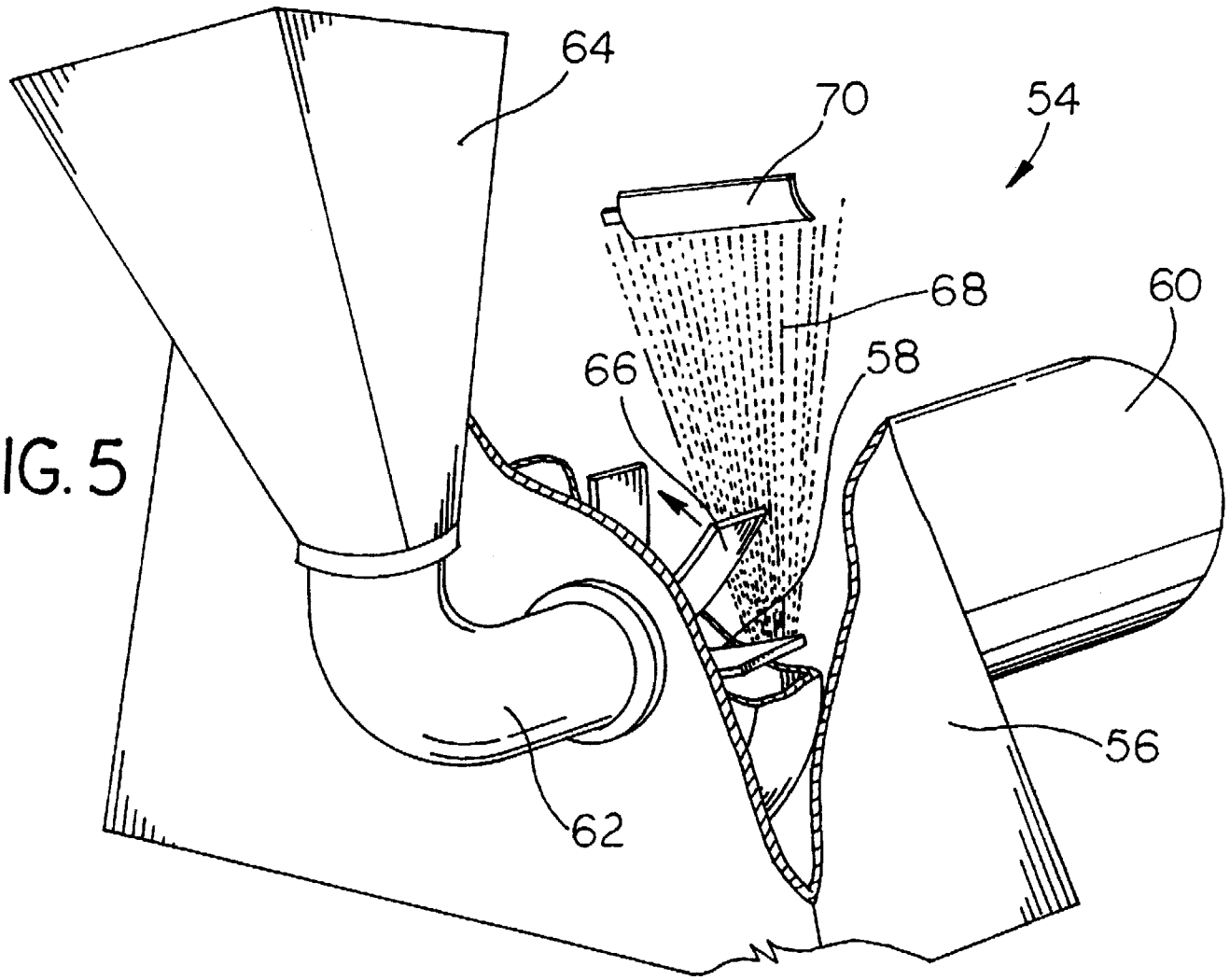
FIG. 5 is a more detailed perspective view of the apparatus used in FIGS. 2–4.

Referring now to FIG. 5, illustrating a more detailed view of the apparatus used in the embodiment of FIGS. 2–4, a shot peening apparatus generally indicated by the numeral 54 includes a housing 56 to which a wheel 58 is rotatably attached. A motor 60 is provided to turn the wheel 58, and a spigot 62 feeds shot from a hopper 64 into the center of the wheel 58, from where it is forced centrifically outwardly along paddies 66 which discharge the shot in a stream 68 in a generally upwardly direction against the workpiece 70 which, as discussed above, may be mounted on a turntable (not shown) so that the workpiece may be rotated to assure even peening of all surfaces. The spent shot drops back into the cabinet (not shown), and may be thereafter returned to the hopper 64. A shot flux control valve (not shown) is installed in the spigot 62 to control the mass flow rate of shot into the wheel 58. While metal shot is commonly used as a peening media, other material, including sand, ceramic bead, plastic bead, nut shells, corn starch and garnet, may be used.

Figure 6:
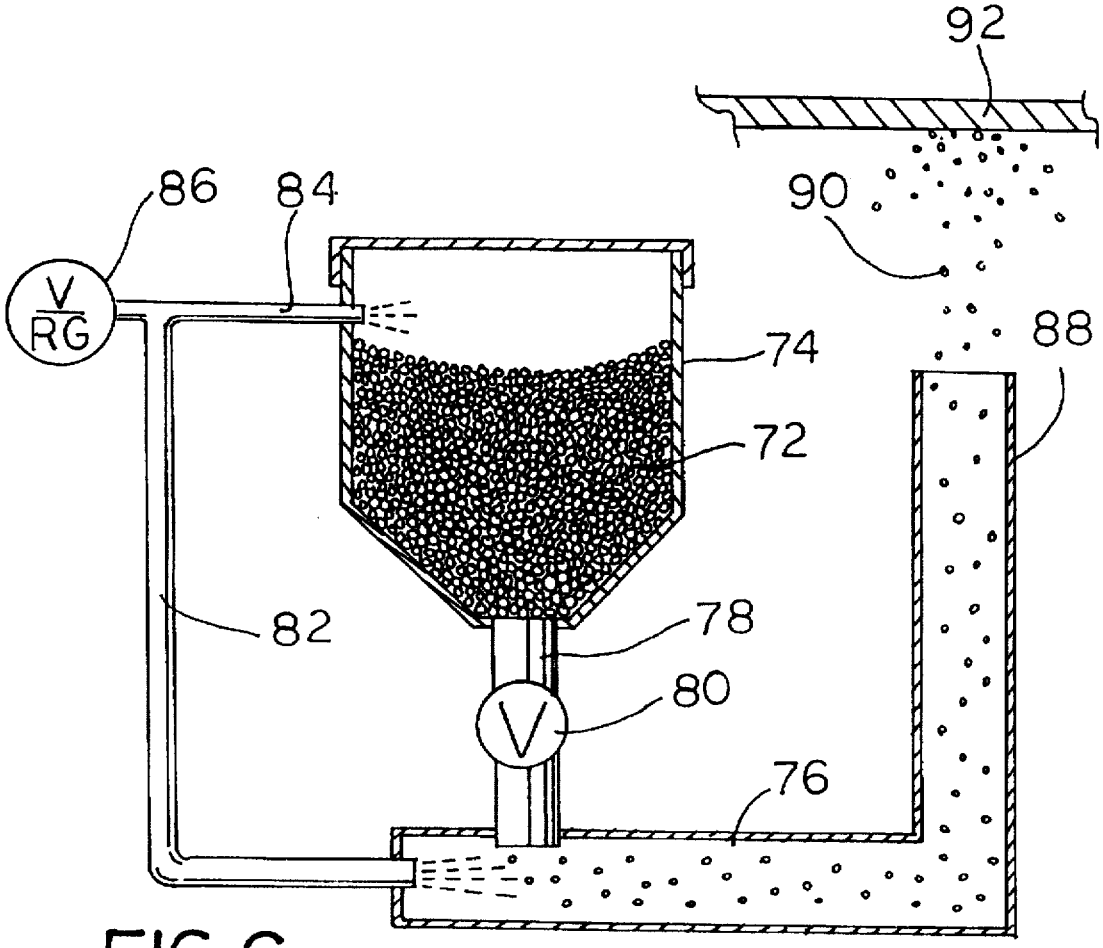
FIG. 6 is a diagrammatic, partly in cross-section, of another embodiment of the peening apparatus pursuant to the present invention.

FIG. 6 illustrates another type of peening apparatus in which the shot is conveyed by gas (usually air) pressure instead of by the peening wheel. While gas pressure is normally used, "wet peening", in which the particles are conveyed by a liquid, may also be used. In FIG. 6, shot 72 is stored in a hopper 74 and is conveyed into hose 76 by tube 78. A mass rate flow of shot through the tube 78 is controlled by conventional shot flux control valve 80. Conduits 82, 84 communicate the hose 76 and the hopper 74 with a source of regulated air pressure, indicating schematically at 86. The hose 76 includes a vertically extending portion 88 through which the shot stream 90 is discharged substantially vertically against the force of gravity. The shot stream 90 will travel upwardly as illustrated in FIG. 6 to form an apex similar to that illustrated in FIG. 2. A workpiece 92, for low intensity, will be placed at the apex, as illustrated in FIG. 6.

Figure 7:
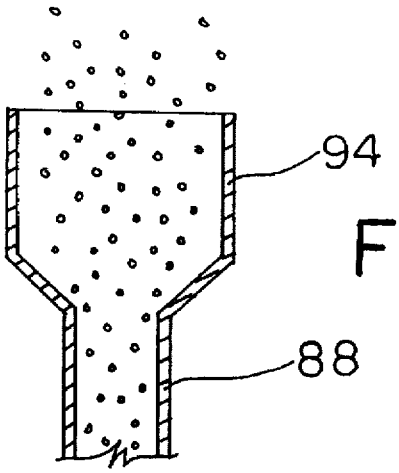
FIG. 7 is fragmentary cross sectional view of a portion of the apparatus shown in FIG. 6, but illustrating a different embodiment of the invention.

Prior art apparatus similar to FIG. 6 had a generally horizontal hose which terminated in a nozzle. Accordingly, a certain minimum air pressure had to be used in order to convey the shot through the hose. This often resulted in a shot velocity substantially higher than that desired for low intensity peening. By directing the hose 76 upwardly at portion 88, and then by adjusting the position of the workpiece 92 within the fountain of shot 90 so produced, the velocity of the shot impacting the workpiece 92 may be closely controlled. Of course, as with the embodiment of FIGS. 2–4, the maximum of velocity occurs just as the shot exits from the vertical portion 88 of the hose 76. Prior art apparatus usually terminated the hose 76 at a nozzle. However, a nozzle accelerates flow. Since it is important to reduce the particle velocity as much as possible to produce low intensity peening, a nozzle is counterproductive and has been omitted from vertically extending segment 88 in FIG. 6. In fact, as illustrated in FIG. 7, it may be desirable to terminate the upward extending section 88 with a diffuser 94, to thereby further reduce the velocity of the shot before it leaves the vertically extending portion 88 of hose 76.

Figure 8:
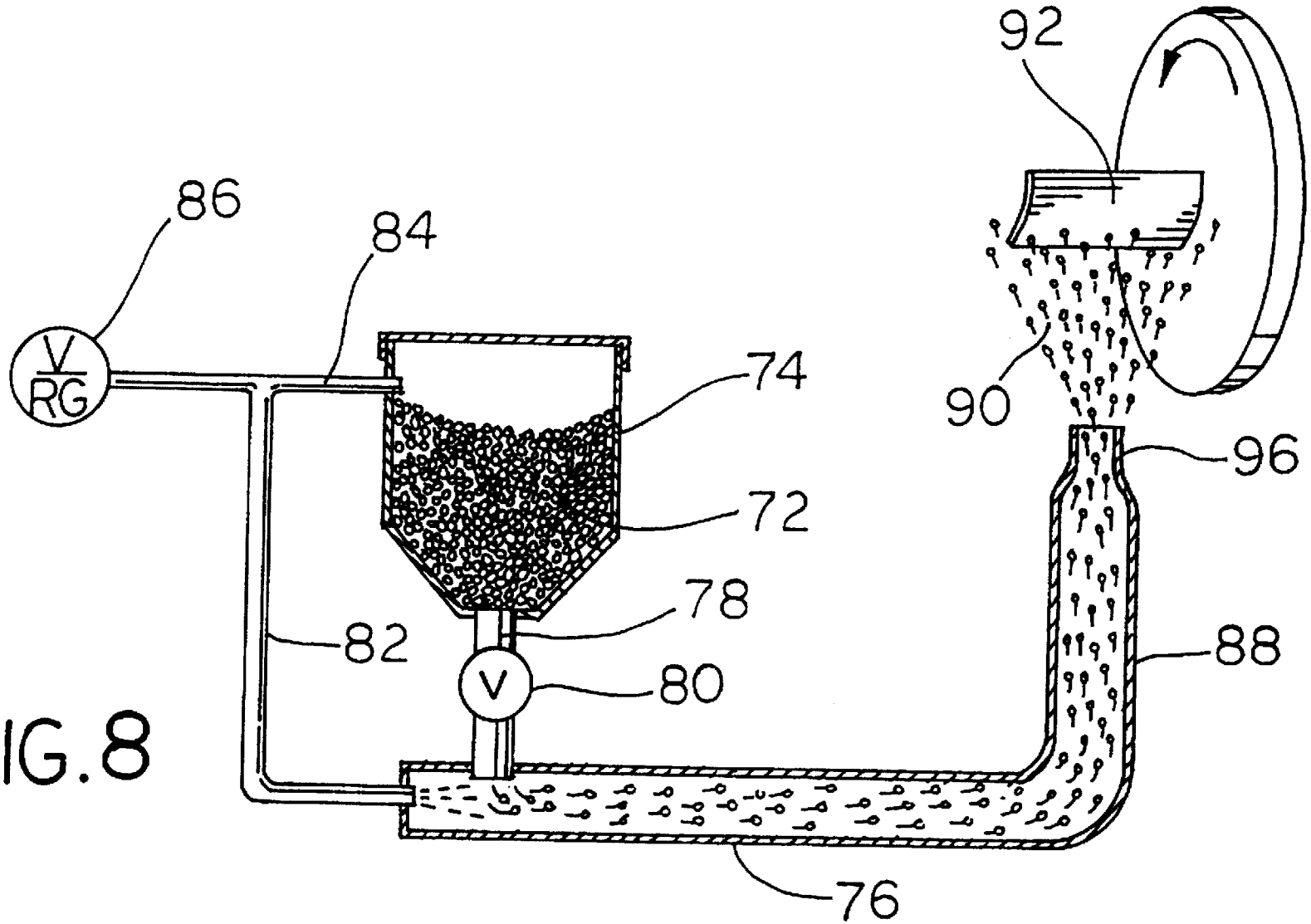
FIG. 8 is a view similar to FIG. 6, but illustrating use of the invention in a air transport system having a nozzle.
Figure 9:
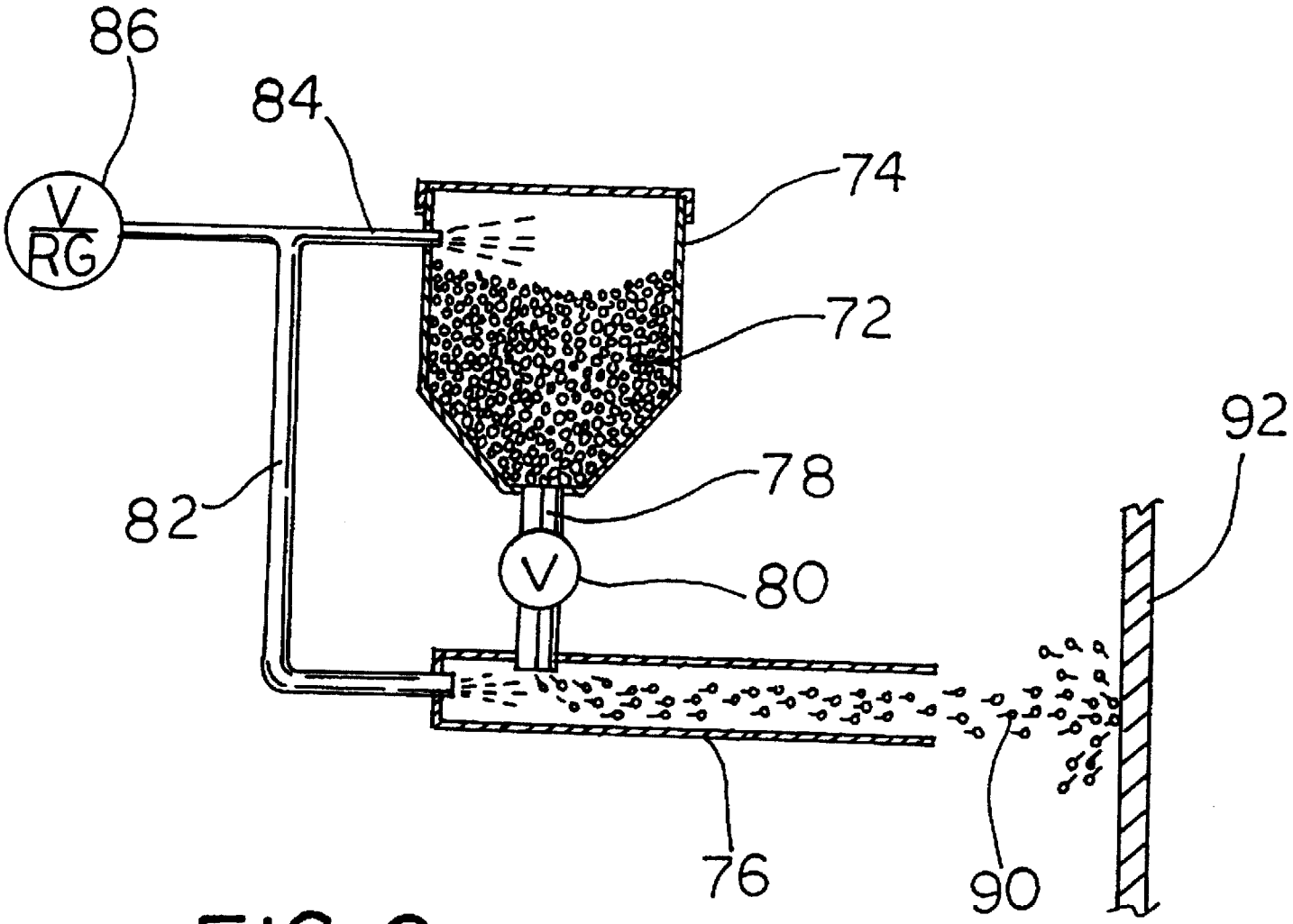
FIG. 9 is a view similar to FIG. 6, but illustrating low intensity peening without a nozzle.

Referring now to the embodiments of FIG. 8 and FIG. 9, elements the same or substantially the same as those of the embodiment of FIG. 6 retain the same reference character. Referring to FIG. 8, the transport hose 76 terminates in an upwardly directed nozzle 96. Accordingly, a conventional transport hose 76 which normally terminates in a nozzle can be used. As discussed above, a certain minimum velocity is required to maintain conveyance of the shot particles 90 in the hose 76. The nozzle 96 accelerates these particles to a velocity above this minimum velocity. However, the fountain formed by the shot stream 90, as discussed above, varies from a maximum velocity at the exit of the nozzle 96 to a minimum velocity at the apex of the fountain (not shown). Accordingly, by adjusting the position of the workpiece 92 within the fountain, the workpiece may be peened at a shot velocity less than the shot velocity at the exit of nozzle 96, and also less than the minimum velocity required to maintain conveyance of the particles in the hose 76.

Referring now to the embodiment of FIG. 9, the transport hose 76 has substantially the same internal flow area throughout, and is not equipped with a nozzle on the terminal end thereof. Accordingly, the shot stream 90 can be discharged from the hose at a velocity equal to the conveyance velocity.

Accordingly, the shot particles are not accelerated by the nozzle, and the velocity of the particles of the shot stream 90 will be less than that available with a conventional transport hose terminating in a nozzle.

What is claimed is:

1. Shot peening method comprising the steps of conveying media into a transport hose at a predetermined mass flow rate, supplying gas under pressure to said hose through an inlet opening for accelerating said media to a conveyance velocity sufficient to convey the media through the hose, aiming said hose at a target workpiece, and discharging said media from a terminal end of said hose toward the target workpiece, orienting said terminal end of the transport hose upwardly to discharge said media upwardly against the force of gravity to form a fountain of media rising toward an apex in which the velocity of said media is a maximum as it is discharged from the terminal end of the hose and decreases until the velocity of the media is zero at the apex, and positioning said workpiece in said fountain at a point where the velocity of the media is no greater than the conveyance velocity.

2. Shot peening method as claimed in claim 1, wherein said terminal end of said hose is unobstructed, and said method includes the step of passing said media through said terminal end of the hose at a velocity which is substantially the same as the conveyance velocity.

3. Shot peening method as claimed in claim 1, wherein said terminal end of said hose is a nozzle, said method including the step of accelerating said media to a velocity greater than the conveyance velocity by passing the media through said nozzle.

4. Method of treating material as claimed in claim 3, including the step of adjusting the distance between said target and said directing means to attain said desired velocity.

5. Method of treating material comprising the steps of accelerating media to a desired velocity, directing said media after acceleration to said desired velocity through a directing means for directing said accelerated media upwardly against the force of gravity to form a fountain whereby said media travels upwardly to an apex in which the velocity of said media is a maximum as it leaves the directing means and decreases until the velocity of the shot is zero at said apex, and mounting a material target for treatment by said media within the fountain formed by said media at a point where the media has a predetermined desired velocity.

6. Method of treating material as claimed in claim 5, including the step of adjusting the height of said apex by increasing the velocity of said shot to increase the height of the apex and reducing the velocity of said shot to decrease the height of the apex.

7. Method of treating material as claimed in claim 6, including the step of adjusting the distance between the material target and the apex to thereby adjust the velocity of the media impacting the material target.

8. Method of treating material as claimed in claim 5, including the step of adjusting the distance between the material target and the apex to thereby adjust the velocity of the media impacting the material target.

9. Method of treating material as claimed in claim 5, wherein said media is selected from the group consisting of metal shot, sand, ceramic bead, plastic bead, nut shells, corn starch and garnet.

10. A shot peening apparatus, comprising:

a holder containing shot;

acceleration means connected to said holder for receiving shot from said holder and for accelerating and discharging said shot from said acceleration means;

directing means for directing said shot out of said acceleration means, said directing means being oriented to discharge said shot upwardly against the force of gravity to form a fountain of shot rising toward an apex in which the velocity of said shot is a maximum as it is discharged from the acceleration means and decreases until the velocity of the shot is zero at said apex, and mounting means for mounting a material target at a point within said fountain where the velocity of said shot is equal to a predetermined desired velocity.

11. The apparatus of claim 10, wherein said acceleration means is a rotating wheel, said shot being conveyed from said holder to said wheel and then accelerated by the rotation of said wheel.

12. The apparatus of claim 10, wherein said directing means includes a hose connected to a source of fluid pressure and to said holder, at least a portion of said hose being oriented to direct said shot upwardly against the force of gravity and onto said target material, said target material being mounted above said portion of the hose.

13. The apparatus of claim 10, wherein a diffuser is mounted on the end of the hose through which said shot is discharged.

* * * * *